US008414331B2

(12) United States Patent
Chang

(10) Patent No.: US 8,414,331 B2
(45) Date of Patent: Apr. 9, 2013

(54) USB CONNECTOR STRUCTURE

(76) Inventor: Nai-Chien Chang, New Taipei (TW)

( * ) Notice: Subject to any disclaimer, the term of this patent is extended or adjusted under 35 U.S.C. 154(b) by 0 days.

(21) Appl. No.: 13/364,332

(22) Filed: Feb. 2, 2012

(65) Prior Publication Data

US 2012/0252273 A1 Oct. 4, 2012

(30) Foreign Application Priority Data

Mar. 28, 2011 (TW) ..... 100205462 U

(51) Int. Cl.
*H01R 13/65802* (2006.01)

(52) U.S. Cl. ..... 439/607.01

(58) Field of Classification Search ..... 439/607.01, 439/607.09, 607.11, 607.32, 660
See application file for complete search history.

(56) References Cited

U.S. PATENT DOCUMENTS

| | | | | |
|---|---|---|---|---|
| 2012/0040567 | A1* | 2/2012 | Ho | 439/660 |
| 2012/0071032 | A1* | 3/2012 | Tsai | 439/660 |
| 2012/0077370 | A1* | 3/2012 | Lee et al. | 439/488 |
| 2012/0077390 | A1* | 3/2012 | Tsai | 439/660 |
| 2012/0196483 | A1* | 8/2012 | Kuster | 439/626 |

* cited by examiner

*Primary Examiner* — Tulsidas C Patel
*Assistant Examiner* — Phuongchi Nguyen
(74) *Attorney, Agent, or Firm* — Chun-Ming Shih; HDLS IPR Services

(57) ABSTRACT

A USB connector structure includes an insulating body, a circuit board, connecting terminals and conductive terminals. The insulating body includes a through notch therein and a plurality of terminal slots at a lower edge of the through notch; the circuit board is coupled to the through notch and has a first surface which set a plurality of goldfingers thereon, and a plurality of blind holes concavely formed at the rear of the goldfingers; each connecting terminal is coupled to a rear end of the circuit board and away from the goldfingers, and electrically connected to each goldfinger through the circuit board; each conductive terminal is coupled to the terminal slot and has a conducting portion disposed at the front of each conductive terminal, and the front of each conducting portion is disposed in the blind hole.

6 Claims, 4 Drawing Sheets

USB CONNECTOR STRUCTURE

FIELD OF THE INVENTION

The present invention relates to an improved connector structure, in particular to an improved USB connector structure.

BACKGROUND OF THE INVENTION

At present, universal serial bus (USB) is one of the most popular transmission interface for computer peripherals and was developed and promoted by Intel and Microsoft and gone through the development process of three versions, respectively: USB 1.0, USB 1.1 and USB 2.0. The standards of USB 1.0, 1.1 and 2.0 support the following three transmission rates: (1) a low-speed transmission rate of 1.5 Mbps; (2) a full-speed transmission rate of 12 Mbps; and (3) a high-speed transmission rate of 480 Mbps.

As the electronic industry advances, even the transmission rate of the USB 2.0 can no longer meets the industrial and user requirements, so that the other USB 3.0 standard is introduced. In the USB 3.0 standard, two sets of differential terminals and a grounding terminal are added to the USB 2.0 having four terminals, so that the USB 3.0 standard has a total of nine terminals, and the transmission rate can reach up to the level of 5 Gbps.

Based on the prior art, a female connector in compliance with the USB 3.0 standard comprises an insulating body, a tongue plate extended from a front end of the insulating body for installing a contact portion of the five added terminals and a contact portion of the original four terminals of the USB 2.0 standard on opposite surfaces of the tongue plate respectively. Since the position of these terminals are standardized, therefore the five added terminals and the original four terminals can be arranged in two rows in the vertical direction, and all terminals are separated from each other to avoid short circuits.

However, computer peripherals and their corresponding connectors tend to be developed with an increasingly thinner, lighter, shorter and smaller design, so that the level of difficulty for installing the nine terminals on the small-size tongue plate is increased significantly and the total volume of the connector cannot be decreased further.

It is a subject for related manufacturers to overcome the aforementioned problems, so that the inventor of the present invention conducted extensive researches and experiments, and finally provided a feasible design to overcome the problems.

SUMMARY OF THE INVENTION

Therefore, it is a primary objective of the present invention to provide an improved USB connector structure capable of simplifying the structure and reducing the volume of the connector to meet the thin design requirement, while preventing the deviation or deformation of the conductive terminals caused by the simplified structure after a long time of use.

To achieve the aforementioned objective, the present invention provides an improved USB connector structure compring: an insulating body, a circuit board, a connecting terminal and a conductive terminal, wherein the insulating body has a through notch formed therein and a plurality of terminal slots formed at a lower edge of the through notch; the circuit board is passed into and coupled to the through notch and has a first surface and a second surface opposite to each other, a plurality of goldfingers at a front end of the first surface, and a plurality of blind holes concavely formed at a rear end of the goldfingers; the connecting terminal has an end passed and disposed at a rear end of the through circuit board and away from the goldfingers, and electrically coupled to each goldfinger; the conductive terminal is passed into and coupled to the terminal slot and has a conducting portion disposed at the front end of each conductive terminal, and the front end of each conducting portion is disposed in the blind hole formed at the rear end of the goldfinger.

Compared with the prior art, the present invention has the following effects. Since the present invention has the plurality of goldfingers installed at the front end of the circuit board directly and the plurality of connecting terminals disposed at the rear end of the circuit board and electrically coupled to the goldfingers to substitute the conventional five conductive terminals, therefore it is not necessary to extend the insulating body from the tongue plate to connect the nine conductive terminals, so as to simplify the structure of the female connector and comply with the thin design requirement. On the other hand, the simplified structure of the present invention reduces the number of required components, and thus reducing the manufacturing cost and time.

In addition, the blind holes are concavely formed at the rear of the plurality of goldfingers on the circuit board, so that the front edge of the conducting portion of each conductive terminal can be disposed in the blind hole to fix each conductive terminal. The invention can prevent each conductive terminal from being deviated or deformed easily after a long time of use, so as to extend the service life of the connector effectively.

DESCRIPTION OF THE PREFERRED EMBODIMENTS

The technical characteristics and contents of the present invention will become apparent with the following detailed description and related drawings. The drawings are provided for the purpose of illustrating the present invention only, but not intended for limiting the scope of the invention.

Figure 5:
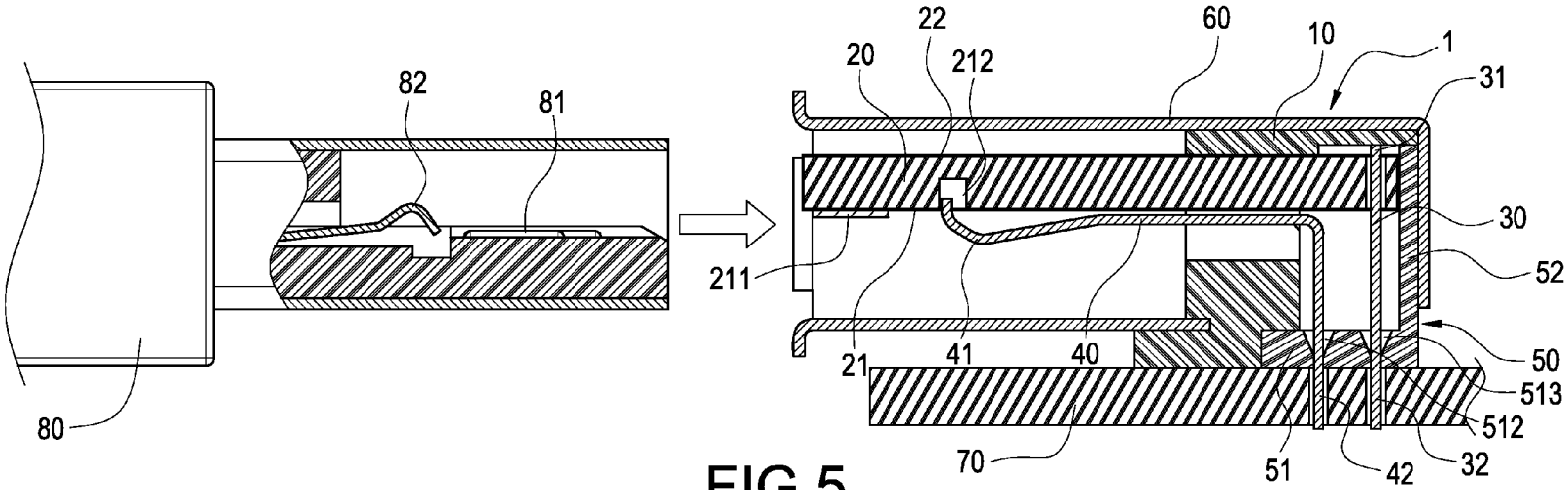
FIG. 5 is a cross-sectional side view of a female connector before being connected to a corresponding male connector in accordance with the present invention.

It is noteworthy to point out that the "front end" mentioned in this specification are defined according to the direction of an opening provided for inserting a male connector 80 (as shown in FIG. 5), and the and the "rear end" refers to the direction opposite to the "front end".

Figure 1:
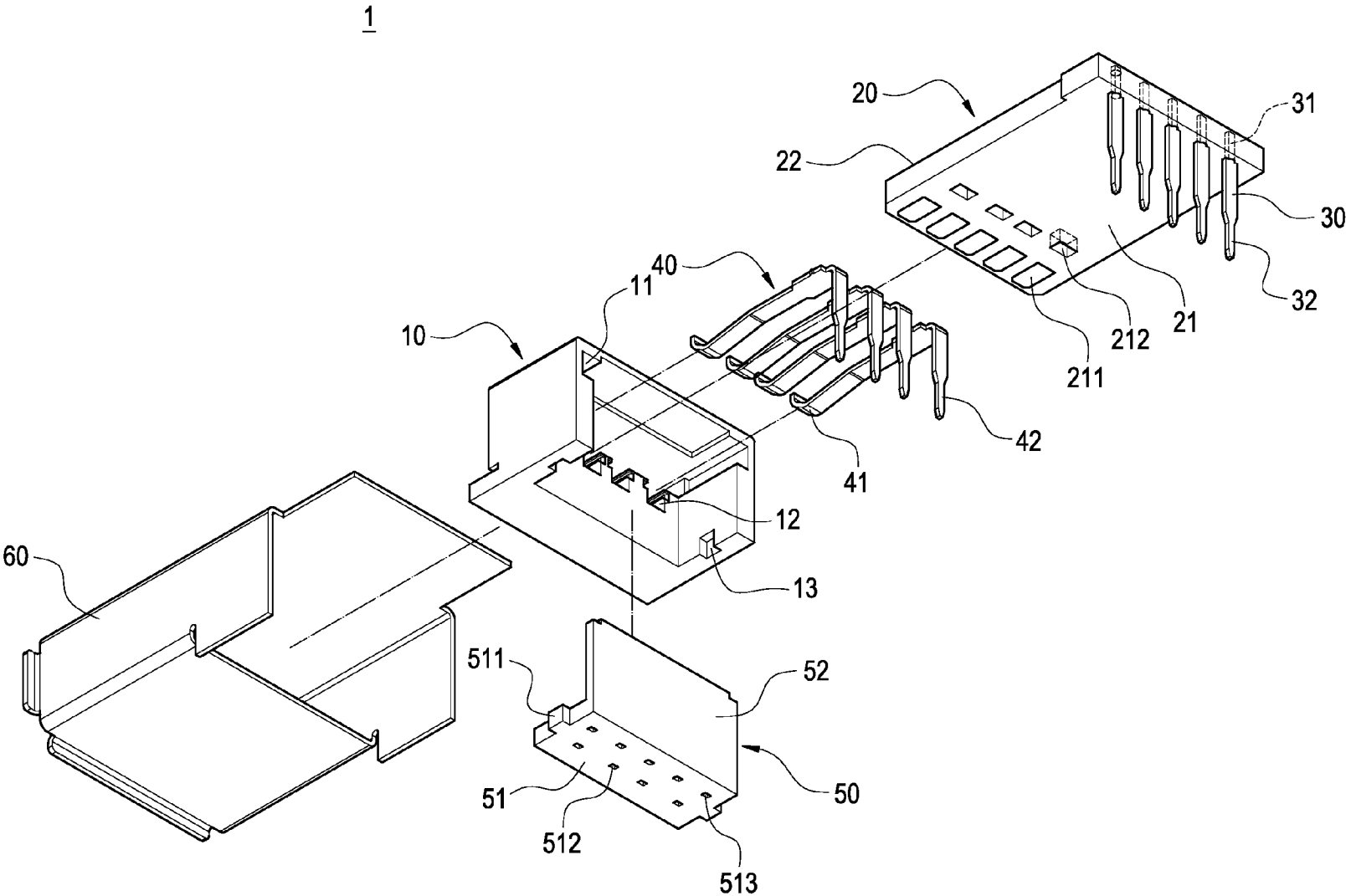
FIG. 1 is an exploded view of the present invention.

With reference to FIG. 1 for an exploded view of the present invention, the present invention provides an improved USB connector structure (hereinafter referred to as "female connector 1"), and this female connector 1 comprises an insulating body 10, a circuit board 20, a plurality of connecting terminals 30, a plurality of conductive terminals 40, a fixed base 50, and a metal casing 60.

The insulating body 10 is made of an insulating material such as plastic or resin, and the insulating body 10 has a through notch 11 formed along the front and rear directions and a plurality of terminal slots 12 formed at a lower edge of the through notch 11. The through notch 11 and the terminal slot 12 penetrate through both front and rear ends of the insulating body 10, wherein the quantity of terminal slots 12 is equal to the quantity of conductive terminals 40. In this preferred embodiment, this quantity is equal to four, but the invention is not limited to this number only.

The circuit board 20 is a thin printed circuit board with a width substantially equal to the width of the through notch 11 of the insulating body 10, so that the circuit board 20 can be passed into and coupled to the through notch 11. The circuit board 20 has a first surface 21 and a second surface 22 disposed opposite to each other. In this preferred embodiment, the first surface 21 refers to the lower surface of the circuit board 20, and the second surface 22 refers to the upper surface of the circuit board 20.

A plurality of goldfingers 211 is formed at the front end of the first surface 21, and the goldfingers 211 are made of conductive copper foil material and formed on the first surface 21. In addition, a plurality of blind holes 212 is concavely formed at the rear of the plurality of goldfingers 211 on the first surface 21 of the circuit board 20, wherein the quantity of goldfingers 211 is equal to the quantity of connecting terminals 30. In this preferred embodiment, this quantity is equal to five. The quantity of blind holes 212 is equal to the quantity of conductive terminals 40. In this preferred embodiment, this quantity is equal to four, but the invention is not limited to this number only. In this preferred embodiment, five goldfingers 211 and four conductive terminals 40 constitute the connecting structure of a universal serial bus (USB) 3.0.

The plurality of connecting terminals 30 is made of a metal conductive material, and each connecting terminal 30 has an end portion 31 disposed at an end of the connecting terminal 30, and a soldering portion 32 disposed at the other end away from the end portion 31. The end portion 31 of each connecting terminal 30 is passed and installed at a rear end of the circuit board 20 and away from the goldfinger 211, and electrically coupled to the plurality of goldfingers 211 on the first surface 21, and each soldering portion 32 is extended in a direction away from the circuit board 20. The quantity of connecting terminals 30 is equal to the quantity of goldfingers 211. In this preferred embodiment, this quantity is equal to five.

The plurality of conductive terminals 40 is made of a metal conductive material, and each conductive terminal 40 is passed into and coupled to the terminal slot 12 of the insulating body 10. In this preferred embodiment, the quantity of conductive terminals 40 is equal to four. Each conductive terminal 40 has a conducting portion 41 at the front of the conductive terminal 40 and a soldering portion 42 formed at a rear end away from each conducting portion 41. When the conductive terminal 40 is passed into and coupled to the terminal slot 12 of the insulating body 10, the conducting portion 41 of each conductive terminal 40 is extended from the front end of the insulating body 10, and the front edge of each conducting portion 41 is disposed in each of the corresponding blind holes 212 on the first surface 21. The soldering portion 42 is protruded from the rear end of the terminal slot 12 and bent and extended downwardly to align parallel with the soldering portion 32 of the plurality of connecting terminals 30.

Figure 2:
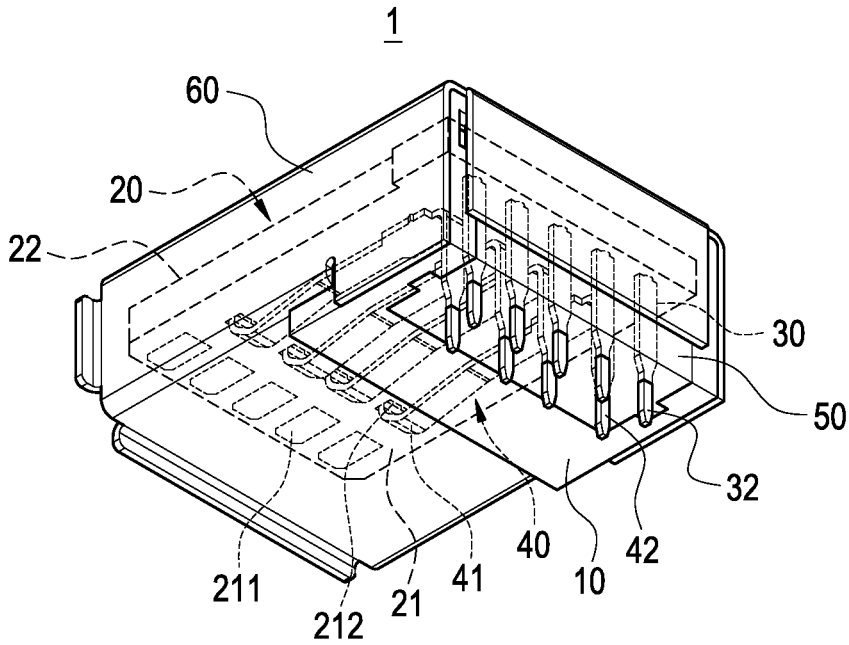
FIG. 2 is a perspective view of a first assembly of the present invention.
Figure 3:
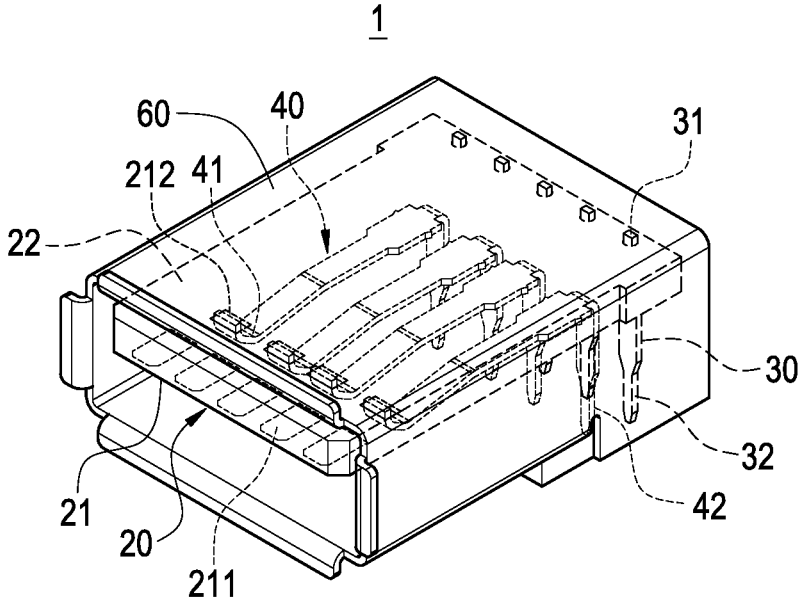
FIG. 3 is a perspective view of a second assembly of the present invention.
Figure 4:
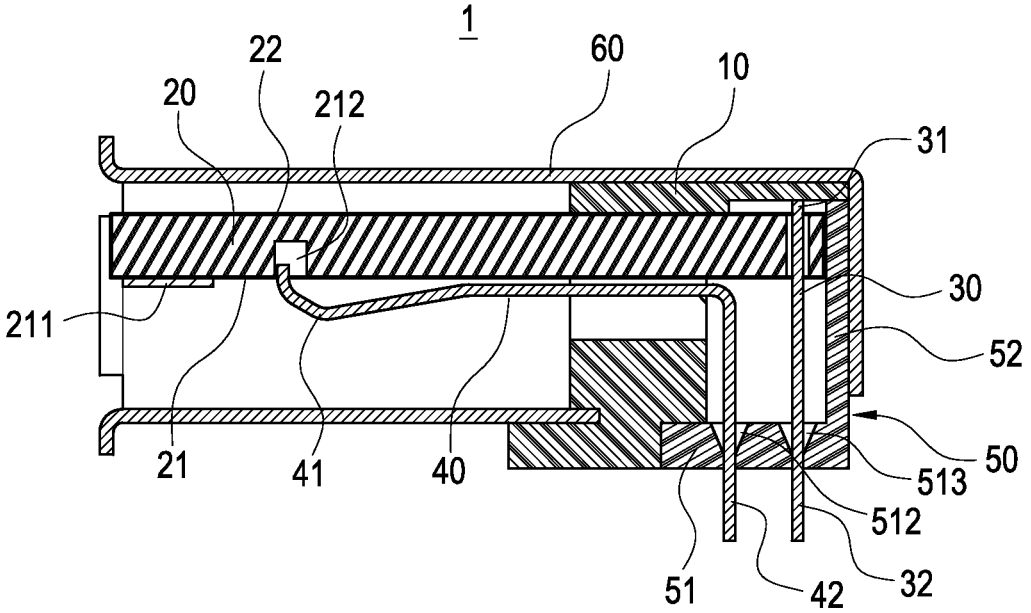
FIG. 4 is a cross-sectional view of the present invention.

With reference to FIGS. 2 and 3 for the first and second assemblies of the present invention respectively, the conducting portion 41 of each of the conductive terminals 40 is disposed at the rear of the goldfinger 211 on the first surface 21. With reference to FIG. 4 for a cross-sectional view of the present invention, the conducting portion 41 is not attached onto the first surface 21 flatly, and the front edge of the conducting portion 41 is disposed in the blind hole 212 on the first surface 21, and the goldfingers 211 on the conducting portion 41 and the first surface 21 are not disposed at the same level height.

In FIG. 1, the fixed base 50 includes a bottom plate 51, a rear cover plate 52 extended vertically upward from the bottom plate 51, and a protruding pillar 511 disposed on both sides of the bottom plate 51 separately. The bottom plate 51 has a plurality of front-row plug holes 512 and a plurality of back-row plug holes 513, wherein the quantity of front-row plug holes 512 is equal to four and provided for inserting the soldering portions 42 of the plurality of conductive terminals 40; and the quantity of back-row plug holes 513 is equal to five and provided for inserting the soldering portions 32 of the plurality of connecting terminals 30. Therefore, the front-row plug holes 512 and the back-row plug holes 513 have same quantity and position as the soldering portions 42 of the plurality of conductive terminals 40 and the soldering portions 32 of the plurality of connecting terminals 30 respectively.

In addition, the soldering portions 42 of the plurality of conductive terminals 40 and the soldering portions 32 of the plurality of connecting terminals 30 are extended downwardly and passed through the front-row plug holes 512 and the back-row plug holes 513, and finally the soldering portions 42, 32 are soldered and electrically coupled to an external circuit substrate 70 (which is an external circuit substrate 70 as shown in FIG. 5), so that the female connector 1 of the present invention can be electrically conducted with the external circuit substrate 70.

The insulating body 10 has a snap slot 13 formed separately on both internal sidewalls of the bottom of the insulating body 10 for embedding and fixing the protruding pillars 511 on both sides of the bottom plate 51 with one another, so that when the fixed base 50 is assembled upwardly to the bottom of the insulating body 10, the protruding pillar 511 of the bottom plate 51 can be snapped into the snap slot 13 at the bottom of the insulating body 10, and the soldering portion 42 of each conductive terminal 40 is passed through the front-row plug hole 512 of the bottom plate 51, so that the soldering portion 32 of each connecting terminal 30 can be passed through the back-row plug hole 513 of the bottom plate 51, and the rear cover plate 52 is covered onto a rear end surface of the insulating body 10 to protect the circuit board 20, the plurality of connecting terminals 30, and the plurality of conductive terminals 40 in the insulating body 10 installed therein.

The metal casing 60 is substantially a rectangular casing that covers the external periphery of the insulating body 10 to shield electromagnetic interference and protect the circuit board 20, the plurality of connecting terminals 30, and the plurality of conductive terminals 40 installed therein.

Figure 6:
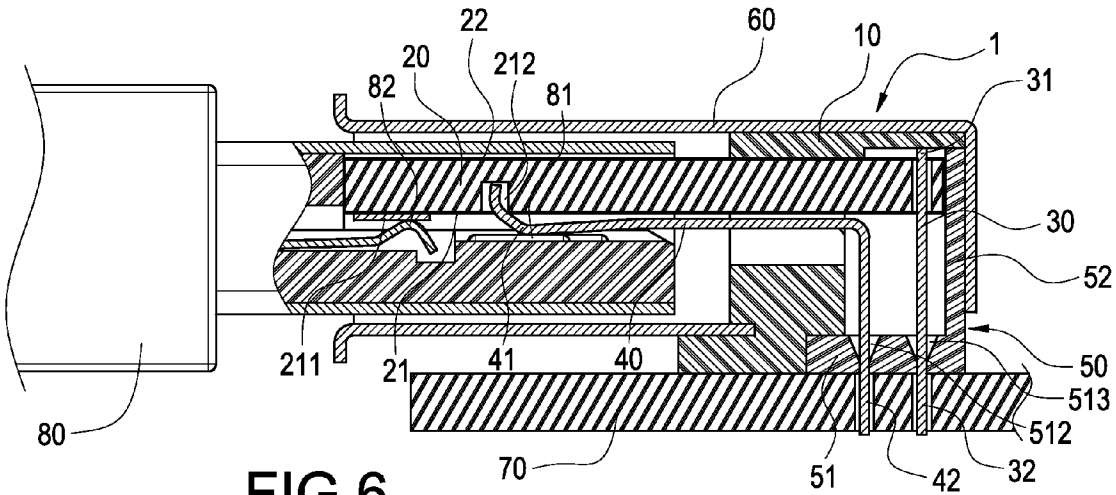
FIG. 6 is a cross-sectional side view of a female connector after being connected to a corresponding male connector in accordance with the present invention.

With reference to FIGS. 5 and 6 for the cross-sectional side views of a female connector 1 before and after being connected to a corresponding male connector in accordance with the present invention respectively, the male connector 80 is a conventional male connector in compliance with the USB 3.0 specification and has four first terminals 81 and five second terminals 82. In FIG. 5, the first terminals 81 are disposed below the second terminals 82 and the first terminals 81 and the second terminals 82 are aligned alternately in different front and back rows.

In FIG. 6, when the female connector 1 and the male connector 80 are inserted and coupled with each other, the goldfingers 211 on the first surface 21 of the circuit board 20 will be in contact with the second terminals 82 in the male connector 80, and the conducting portions 41 of the conductive terminal 40 will be in contact with the first terminals 81 in the male connector 80, so that the female connector 1 and the male connector 80 can be electrically conducted. It is noteworthy to point out that when the conducting portion 41 of the conductive terminal 40 presses and touches the first terminal 81 in the male connector 80, the front edge of each conducting portion 41 is sunk into the blind hole 212 on the first surface 21. Therefore, the plurality of blind holes 212 can be used to position each conductive terminal 40, such that each conductive terminal 40 will not be deviated or deformed easily by the insertion of the male connector 80, so as to reduce the failure rate of the connector.

Compared with the prior art, the present invention has a plurality of goldfingers 211 installed at the front end of the circuit board 20 directly and a plurality of connecting terminals 30 installed at the rear end of the circuit board 20 and electrically coupled to the goldfingers 211 to substitute the conventional five conductive terminals, and the insulating body 10 is no longer required to extend from the tongue plate to connect nine conductive terminals, so as to simplify the structure of the female connector 1 significantly and comply with the thin design requirement. On the other hand, the simplified structure of the present invention requires less number of components, so that the manufacturing cost and time can be reduced. In addition, the plurality of blind holes 212 concavely formed at the rear end of the plurality of goldfingers 211 on the circuit board 20 is provided for receiving the front edge of the conducting portion 41 of each conductive terminal 40, so that the conductive terminal will not be deviated or deformed easily after a long time of use, so as to extend the service life of the connector.

While the invention has been described by means of specific embodiments, numerous modifications and variations could be made thereto by those skilled in the art without departing from the scope and spirit of the invention set forth in the claims.

What is claimed is:

1. A USB connector structure, comprising:

an insulating body, having a through notch formed herein and a plurality of terminal slots formed at a lower edge of the through notch;

a circuit board, passed into and coupled to the through notch, and having a first surface and a second surface disposed opposite to each other, a plurality of goldfingers disposed at a front end of the first surface, and a plurality of blind holes concavely formed at a rear side of the plurality of goldfingers;

a plurality of connecting terminals, having an end portion disposed at an end of the connecting terminals, and passed into the circuit board and at a position away from the rear end of the plurality of goldfingers, and respectively and electrically coupled to the goldfingers; and a plurality of conductive terminals, passed into and coupled to the terminal slots respectively, and having a conducting portion disposed at a front end of each conductive terminal and disposed at the rear end of the goldfingers, and the front edges of the conducting portions being disposed in the plurality of blind holes respectively; wherein the conducting portions and the goldfingers on the first surface are situated at different level heights; wherein the goldfingers on the first surface come with a quantity of five; wherein the connecting terminals come with a quantity of five; wherein the terminal slots come with four.

2. The USB connector structure of claim 1, wherein the conductive terminals come with a quantity of four.

3. The USB connector structure of claim 1, further comprising a metal casing covered onto the external periphery of the insulating body.

4. The USB connector structure of claim 3, wherein each of the connecting terminals has a soldering portion disposed at the other end away from the end portion, and the soldering portions are extended in a direction away from the circuit board, and each the conductive terminals has a soldering portion disposed at the other end away from the conducting portion, and the soldering portions are protruded from the rear end of the terminal slot and bend and extended downwardly to align parallel to each of the soldering portions of the connecting terminals.

5. The USB connector structure of claim 4, further comprising a fixed base coupled to the bottom of the insulating body, and the fixed base having front-row plug holes and back-row plug holes, and the quantity of front-row plug holes being equal to the quantity of conductive terminals, and provided for inserting and coupling the soldering portions of the conductive terminals, and the quantity of back-row plug holes being equal to the quantity of connecting terminals and provided for inserting and coupling the soldering portions of the connecting terminals.

6. The USB connector structure of claim 4, wherein the soldering portions of the connecting terminals and the soldering portions of the conductive terminals are soldered and electrically coupled to an external circuit substrate.

* * * * *